United States Patent [19]

Sasaki

[11] 4,086,573

[45] Apr. 25, 1978

[54] ALARM CONTROL DEVICE

[75] Inventor: Isao Sasaki, Tokyo, Japan

[73] Assignee: Nittan Company, Japan

[21] Appl. No.: 627,609

[22] Filed: Oct. 31, 1975

[30] Foreign Application Priority Data

Nov. 20, 1974 Japan ..... 49-139562[U]
Nov. 20, 1974 Japan ..... 49-139563[U]

[51] Int. Cl.[2] ..... G08B 23/00
[52] U.S. Cl. ..... 340/213 R; 340/276
[58] Field of Search ..... 340/213 R, 213.1, 276, 340/412, 420, 213.2, 409; 307/217, 218; 328/92, 93, 94, 95; 317/148.5 B

[56] References Cited

U.S. PATENT DOCUMENTS

| | | | |
|---|---|---|---|
| 2,709,250 | 5/1955 | Marmorstone | 340/213.1 |
| 2,947,980 | 8/1960 | Lemm et al. | 340/213.1 |
| 3,525,988 | 8/1970 | Linder | 340/213 R |
| 3,537,094 | 10/1970 | Hawkins et al. | 340/276 |
| 3,540,043 | 11/1970 | Crosthwait | 340/276 |
| 3,641,547 | 2/1972 | Reiss et al. | 340/276 |
| 3,671,760 | 6/1972 | Holmes | 340/213 R |

*Primary Examiner*—John W. Caldwell, Sr.
*Assistant Examiner*—Donnie L. Crosland
*Attorney, Agent, or Firm*—Eugene F. Geoffrey, Jr.

[57] ABSTRACT

An alarm control device wherein said alarm is responsive to a plurality of detectors so that actuation of any specific detector will operate the alarm and thereafter the alarm can be manually terminated and wherein means are included to permit operation of the alarm upon the actuation of other detectors. In this way termination of the alarm after actuation of one detector will not totally inactivate the alarm should any of the other detectors be actuated thereafter.

3 Claims, 2 Drawing Figures

ALARM CONTROL DEVICE

Figure 1:
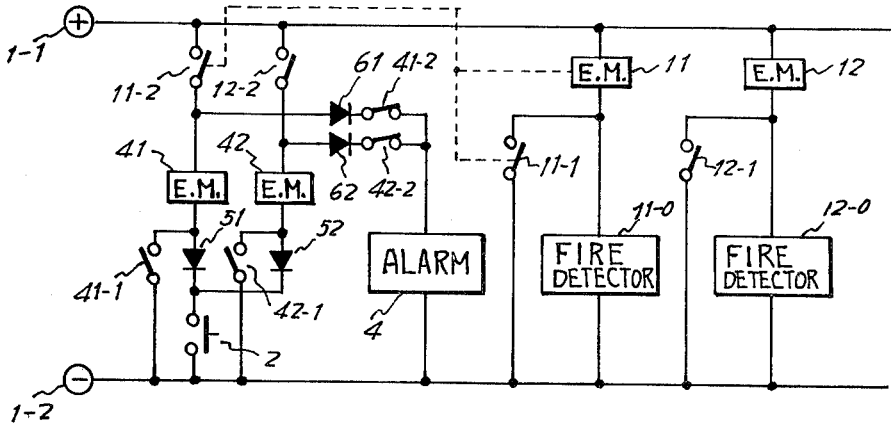

This invention relates to a novel and improved alarm control device, which is especially useful for the control of an alarm device in cooperation with a plurality of emergency detectors such as fire detectors.

For instance, in the case of controlling a plurality of groups of fire detectors, which are respectively installed in a plurality of buildings, for giving an alarm throughout all the buildings when any detector of any group senses a fire, it has been the general practice to stop the alarm after a predetermined lapse of time. In such arrangement, however an alarm cannot be given if a detector of another group senses another fire which breaks out independently or as the result of spreading of the fire.

Accordingly, an object of this invention is to provide a novel and improved alarm control device which can give an alarm automatically even after the alarm is once stopped.

According to this invention, the alarm control device comprises a power supply, a plurality of detectors each having a self-holding relay, a switching means actuated upon operation of its associated detector, second switching means associated with and actuated by the first switching means, the second switching means having both self-holding means and alarm actuating circuit means, the latter completing a circuit from the power supply through alarm means, and means for actuating said second switching means whereby said second switching means remains in the actuated condition and interrupts operation of the alarm.

Other objects and features of this invention will be described in more detail hereinunder with reference to the accompanying drawings.

Figure 2:
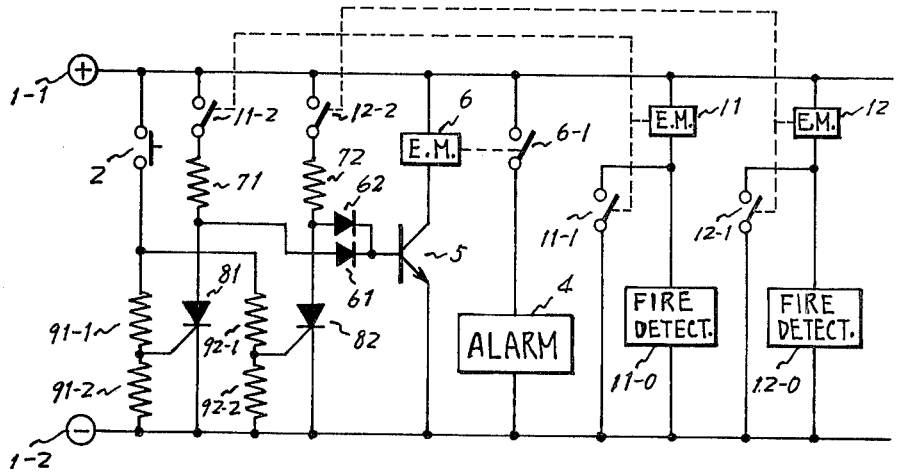

In the drawings:

FIG. 1 is a schematic circuit diagram representing an embodiment of the invention; and FIG. 2 is a schematic circuit diagram representing another embodiment of the invention.

Throughout the drawings, like reference numerals are used to denote corresponding structural components.

The principle of operation of the invention can be realized for example by the circuit of FIG. 1. In FIG. 1, series connections, each consisting of an electromagnet 11, 12, . . . , and a fire detector 11-0, 12-0, . . . , are connected in parallel between the positive and negative terminals 1-1 and 1-2 of a DC power supply (not shown). The fire detectors 11-0, 12-0, . . . , are of a conventional type in which both terminals are short-circuited when they sense a fire, and are provided in parallel with normally-open switches 11-1, 12-1, . . . , respectively, which are to be closed by the electromagnets 11, 12, . . . , respectively, when energized. Thus, the operation of the each fire detector is apparently maintained by the self-holding switch 11-1, 12-1, . . .

The electromagnets 11, 12, . . . , also drive normally-open switches 11-2, 12-2, . . . , respectively, each having one terminal connected to the positive terminal 1-1 of the power supply. The other terminals of the switches 11-2, 12-2, . . . , are connected respectively, through electromagnets 41, 42, . . . , to the anode terminals of diodes 51, 52, . . . having cathode electrodes connected in common through a normally-open switch 2 such as pushbutton switch to the negative terminal 1-2 of the power supply. The anode terminals of the diodes 51, 52, . . . are also connected through normally-open switches 41-1, 42-1, . . . respectively to the negative terminal 1-2 of the power supply. The other terminals of the switches 11-2, 12-2, . . . are also connected respectively through anode-to-cathode paths of diodes 61, 62, . . . , normally-closed switches 41-2, 42-2, . . . , and a common alarm device 4 to the negative terminal 1-2 of the power supply. The switches 41-1, 42-1, . . . and 41-2, 42-2, . . . are arranged to be actuated in response to energization of the electromagnets 41, 42, . . . , respectively.

When, for example, the fire detector 11-0 senses a fire, a current path from the positive terminal 1-1 through the electromagnet 11 and the fire detector 11-0 to the negative terminal 1-2 is completed to energize the electromagnet 11. The electromagnet 11 closes the switch 11-1 to self-hold its energization. As the switch 11-2 is also closed by the electromagnet 11, a current path from the positive terminal 1-1 through the switch 11-2, diode 61, switch 41-2 and the alarm device 4 is completed to energize the alarm device 4. As the energization of the electromagnet 11 is self-held by the switch 11-1, the alarm device 4 gives the alarm continuously.

In this condition, however, if the push-button switch 2 is closed, a current flows through a path consisting of the switch 11-2, electromagnet 41, diode 51 and switch 2 to energize the normally-open switch 41-1 to self-hold the energization and, at the same time, opens the normally-closed switch 41-2 to de-energize the alarm device 4.

It should be self-evident that the same operation will be obtained if any fire detector other than the fire detector 11-0 senses a fire first or after another detector.

FIG. 2 shows another embodiment which can realize the principle of FIG. 1. In FIG. 2, the arrangement of the electromagnets 11, 12, . . . , fire detectors 11-0, 12-0, . . . , and switches 11-1, 12-1, . . . and 11-2, 12-2, . . . , is exactly the same as that of FIG. 2. The other terminals of the normally-open switches 11-2, 12-2, . . . , are respectively connected through resistors 71, 72, . . . and the anode-to-cathode paths of silicon controlled rectifiers (hereinunder referred to as "SCR") 81, 82, . . . to the negative terminal 1-2 of the power supply (not shown). The anode terminals of the SCR's 81, 82, . . . are also connected through the anode-to-cathode paths of diodes 61, 62, . . . , respectively, to the base electrode of a transistor 5 whose collector-to-emitter path is connected in series with an electromagnet 6 between the both terminals 1-1 and 1-2 of the power supply. Between the both terminals 1-1 and 1-2, there is also connected a series connection of a normally-open switch 6-1 which is to be actuated by the electromagnet 6, and an alarm device 4. The positive terminal 1-1 of the power supply is further connected through a normally-open switch 2 and a parallel connection of pairs of serial voltage dividing resistors 91-1 and 91-2, 92-1, and 92-2, . . . are respectively connected to the control electrodes of the SCR's 81, 82, . . .

When, for example, the fire detector 11-0 senses a fire, the normally-open switch 11-2 is closed as in the case of FIG. 2 to supply a voltage from the positive terminal 1-1 of the power supply through the switch 11-2, resistor 71 and diode 61 to the base electrode of the transistor 5 to drive it into conduction. This results in the energization of the electromagnet 6 and the closure of the incorporated normally-open switch 6-1 and consequent energization of the alarm device 4. As the energization of the electromagnet 11 is self-held as in the case of FIG. 1, the alarm device 4 gives the alarm continuously.

If the push-button switch 2 is closed temporarily in this condition, a voltage appearing at the junction of the voltage dividing resistors 91-1 and 91-2 is applied to the control electrode of the SCR 81 to drive it into conduction. This results in a drop of the base potential level of the transistor 5 to the emitter potential level and consequent nonconduction of the transistor 5. Thus, the electromagnet 6 is de-energized to restore the switch 6-1 to open state and the alarm device 4 is de-energized to stop the alarm.

In this embodiment too, as in the foregoing embodiment of FIG. 1, it should be self-evident that the same operation will be obtained if any detector other than the detector 11-0 senses a fire before or after the detector 11-0.

Moreover, the correspondences of the elements of the circuit of FIG. 1 to the elements of the circuit of FIG. 2 should be also self-evident for those skilled in the art.

What is claimed is:

1. An alarm control device comprising a plurality of detecting means connected between two terminals of an energy source for detecting emergency conditions, each of said detecting means including first switching means actuated by said detecting means and having self-holding means, second switching means interconnected with said first switching means and including both selfholding means and alarm actuating circuit means interconnected with one of said terminals, a connection between said alarm actuating circuit means and said first switching means to connect said alarm actuating circuit to the other of said terminals upon actuation of said first switching means, an alarm connected in common with each of said alarm actuating circuit means of said second switching means and said one of said terminals, said alarm being actuated upon actuation of said first switching means through said alarm actuating circuit means of said second switching means, common switching means interconnected with each of said second switching means and operable to temporarily actuate each of second switching means associated with an actuated detector whereby each of said second switching means remains in the actuated condition until deactivation of its associated first switching means, each of said second switching means upon activation preventing continued sounding of the alarm produced by its associated detector.

2. An alarm control device, according to claim 1, wherein said common switching means comprises a normally-open temporary-make switch, each of said second switching means comprising an electromagnetic relay connected to said first switching means and said temporary-make switch, each of said alarm actuating circuit means comprises normally-closed contacts on said second switching means having one contact connected to the other side of said energy source through said first switching means and the second of said contacts being connected to said alarm, said contacts being opened upon activation of said electromagnetic relay.

3. An alarm control device, according to claim 1, wherein each of said second switching means comprises a silicon controlled rectifier having a gate electrode connected to said common switching means and a conduction path including a resistor connected to the first switching means, a transistor having a base electrode and a conduction path, third switching means interconnected with said conduction path and said alarm, unidirectional conduction means connected between the junction of said resistor and silicon controlled rectifier and the base electrode of said transistor.

* * * * *